US005692460A

United States Patent [19]

Froeschl et al.

[11] Patent Number: 5,692,460

[45] Date of Patent: Dec. 2, 1997

[54] COOLANT TEMPERATURE CONTROL SYSTEM FOR AN INTERNAL-COMBUSTION ENGINE

[75] Inventors: Joachim Froeschl, Herrsching; Gerhart Huemer; Dieter Wittelsberger, both of Munich; Wolfgang Schmidt, Neuburg; Heinz Lemberger, Unterfoehring; Guenter Ranzinger, Garching; Dietmar Franz, Eching; Ralf Weiss, Emmering, all of Germany

[73] Assignee: Bayerische Motoren Werke Aktiengesellschaft, Munich, Germany

[21] Appl. No.: 660,101

[22] Filed: Jun. 7, 1996

Related U.S. Application Data

[63] Continuation of Ser. No. 601,124, Feb. 14, 1996.

[30] Foreign Application Priority Data

Feb. 14, 1995 [DE] Germany ..... 195 04 893.8

[51] Int. Cl.[6] ..... F01P 7/14

[52] U.S. Cl. ..... 123/41.1; 123/41.15

[58] Field of Search ..... 123/41.1, 41.15, 123/198 D

[56] References Cited

U.S. PATENT DOCUMENTS

| | | | |
|---|---|---|---|
| 4,672,920 | 6/1987 | Duprez | 123/41.15 |
| 5,477,816 | 12/1995 | Ranzinger et al. | 123/41.1 |

FOREIGN PATENT DOCUMENTS

| | | |
|---|---|---|
| 0 644 320 A1 | 3/1995 | European Pat. Off. . |
| 0 664 383 A1 | 7/1995 | European Pat. Off. . |
| 32 16 032A1 | 2/1983 | Germany . |
| 35 05 835A1 | 8/1985 | Germany . |
| 8702534 U | 8/1988 | Germany . |
| 9115114 U | 4/1992 | Germany . |
| 43 24 178A1 | 1/1995 | Germany . |
| 44 09 547A1 | 1/1995 | Germany . |

OTHER PUBLICATIONS

*VDI–Berichte* (*VDI–Reports*), No. 515, 1984, pp. 161–165.

*Primary Examiner*—Noah P. Kamen

*Attorney, Agent, or Firm*—Evenson, McKeown, Edwards & Lenahan, P.L.L.C.

[57] ABSTRACT

A coolant temperature control system for an internal-combustion engine in a motor vehicle having an electrically heatable thermostatic valve whose method of operation can be shifted by electrical heating in the radiator operation direction. Control devices are provided for recognizing a defect of another system in the motor vehicle which controls the coolant flow. When a defect of this other system is recognized, the thermostatic valve is heated. Particularly when a defect is recognized, the heating of the thermostatic valve is controlled such that the coolant temperature is maintained below a preset coolant temperature threshold. Preferably, the recognition of a defect is carried out by means logically monitoring output signals of the other system.

11 Claims, 1 Drawing Sheet

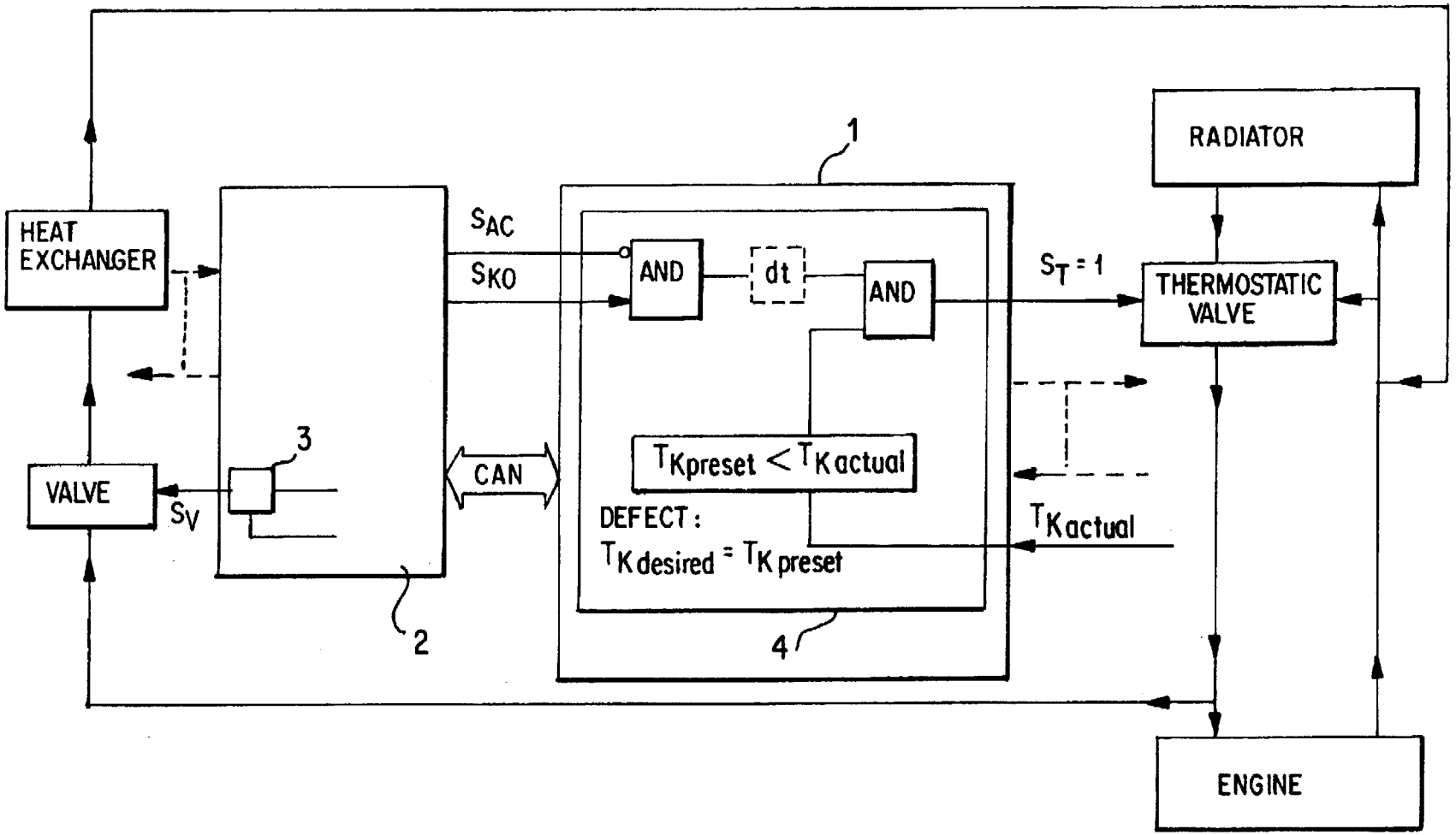
RADIATOR
THERMOSTATIC VALVE
ENGINE
$S_T = 1$
$T_{K\,actual}$
1
AND
dt
AND
$T_{K\,preset} < T_{K\,actual}$
DEFECT:
$T_{K\,desired} = T_{K\,preset}$
4
$S_{AC}$
$S_{KO}$
CAN
2
3
$S_V$
HEAT EXCHANGER
VALVE

COOLANT TEMPERATURE CONTROL SYSTEM FOR AN INTERNAL-COMBUSTION ENGINE

BACKGROUND AND SUMMARY OF THE INVENTION

This application is a continuation application of U.S. patent application Ser. No. 08/601,124, filed on Feb. 14, 1996.

This invention relates to a coolant temperature control system for an internal-combustion engine in a motor vehicle having an electrically heatable thermostatic valve whose method of operation can be shifted in the radiator operation direction by electrically heating the thermostatic valve.

A coolant temperature control system of this type is known, for example, from German Patent Document DE 43 24 178 A1. In the case of the cooling unit for an internal-combustion engine known from German Patent Document DE 43 24 178 A1, a radiator and a thermostatic valve are provided which control the temperature of the coolant in a warming-up operation, a mixing operation and a radiator operation. In this case, the thermostatic valve contains an expansion material element which can be electrically heated for reducing the coolant temperature. In the case of this thermostatic valve, the expansion material element is designed such that, without any heating of the expansion material element in the warming-up operation and/or in the mixing operation, the coolant temperature is controlled to an upper working limit temperature. This upper working limit temperature is preferably equal to the operating temperature of the internal-combustion engine most advantageous for fuel consumption and is only slightly lower than a maximally permissible operating temperature. This upper working limit temperature may, for example, be approximately 105° C.

However, in the long run, this upper working limit temperature may be too high for other systems regulating the coolant flow. In the normal operation, that is, when there is no defect, the coolant flow control of the other system can normally prevent overheating. For example, in the case of heating or air-conditioning systems, the heat exchanger temperature is controlled by timed control of valves in permissible ranges. When there is a defect, however, for example, a constantly opened valve, the coolant can flow into the heat exchanger in an unhindered manner. Particularly in the case of a coolant temperature around the range of the upper working limit temperature, this may result in disturbances, damage and possibly in a total breakdown of the heating or air-conditioning system.

It is an object of the present invention to improve a coolant temperature control system of the type described generally above such that other systems through which the coolant of the internal-combustion engine flows are not damaged, particularly at high coolant temperatures.

These and other objects have been achieved according to the present invention by providing a coolant temperature control system for the cooling unit of an internal-combustion engine in motor vehicles, having an electrically heatable thermostatic valve whose method of operation can be shifted in the direction of radiator operation by heating the valve.

A control device recognizes a defect of another system in the motor vehicle which controls the coolant flow. When a defect of this other system is recognized, the thermostatic valve is heated.

Heating the thermostatic valve shifts the method of operation of the thermostatic valve in the radiator operation direction, in order to reduce the coolant temperature when there is a defect. This generally protects all systems and parts which come in contact with the coolant from overheating.

According to an advantageous further development, when a defect is recognized, heating of the thermostatic valve is controlled such that the coolant temperature will be below a preset coolant temperature threshold.

Consequently, the other systems are protected from overheating in the case of a defect. Additionally, by presetting the coolant temperature threshold, a sufficient coolant temperature can still be maintained. Accordingly, the advantages of a high coolant temperature for the internal-combustion engine, for example, lower fuel consumption, do not have to be given up completely. Thus, a compromise is achieved with respect to the coolant temperature between the demands on the internal-combustion engine and the demands on other systems through which the coolant flows.

According to another advantageous embodiment of the invention, a defect is recognized by logically monitoring output signals of the systems through which the coolant flows.

Preferably, these output signals are existing input signals of a control unit which generally controls the electrical heating of the thermostatic valve. Consequently, another function of the coolant temperature control system is permitted without the requirement of having to carry out constructive changes of the hardware. For example, a separate defect signal line is not necessary.

These and other objects, features, and advantages of the present invention will become more readily apparent from the following detailed description when taken in conjunction with the accompanying drawing.

BRIEF DESCRIPTION OF THE DRAWINGS

The drawing illustrates an embodiment of the invention. It is a view of a possible arrangement for the implementation of the coolant temperature control system according to the invention, particularly a block diagram for recognizing a defect and subsequently heating the thermostatic valve.

DETAILED DESCRIPTION OF THE DRAWINGS

An electronic engine control unit 1, which also controls other functions of an internal-combustion engine in motor vehicles which are not shown here, contains, among other things, a function block 4. The electronic engine control unit 1 has a plurality of input and output signals. A possible output signal is, for example, the heating actuation switching signal $S_T$ for the thermostatic valve. Input signals of the electronic engine control unit 1 are the coolant temperature signal $T_{Kactual}$, an air-conditioning-unit readiness signal $S_{AC}$ and an air-conditioning compressor switch-on signal $S_{KO}$. The air-conditioning system readiness signal $S_{AC}$ and the air-conditioning compressor switch-on signal $S_{KO}$ are output signals of an air-conditioning control unit 2 of an air-conditioning system which, in this case, is an example of another system controlling the coolant flow. The air-conditioning control unit 2 emits, among other things, a valve switching signal $S_v$ which controls a valve in a timed manner particularly by means of a pulse-width-modulated signal in order to correspondingly control the flow of the coolant for the internal-combustion engine for reaching a desired heat exchanger temperature. For a more detailed explanation of the method of operation of heating and air-conditioning systems, reference is made to conventional air-conditioning systems, as described, for example, in *VDI-Berichte* (*VDI-Reports*), No. 515, 1984, Pages 161, and on. In addition or as an alternative, the air-conditioning control unit 2 of an air-conditioning system can also exchange input and output signals with the electronic engine control unit by way of a bus system, as, for example, the known motor vehicle bus CAN.

The air-conditioning control unit 2 includes a driver circuit 3, which emits a valve switching signal $S_v$ as a function of various input signals, such as signals of the operating unit of an air-conditioning system. By way of the diagnostic driver circuit 3, the air-conditioning control unit 2 recognizes when no proper valve switching signal $S_v$ can be emitted. For example, as a result of a defect, the valve switching signal $S_v$ may cause a constant opening of the valve. As a result, heated coolant would flow unhindered through the heat exchanger and endanger the operability of the air-conditioning system. This is an example of the presence of a defect of a system controlling the coolant flow which is first recognized by the air-conditioning control unit 2 and is then reported, for example, to the electronic engine control unit 1 or to the function block 4.

The defect may be reported, for example, via the CAN bus or, if such a bus does not exist, via the air-conditioning system readiness and air-conditioning compressor switch-on signals $S_{AC}$ and $S_{KO}$ which exist anyhow. Normally, for example for controlling the idling rotational speed when the motor vehicle is inoperative, the electronic engine control unit 1 is informed by way of the air-conditioning readiness signal $S_{AC}$ that a switch-on request for the air-conditioning unit is present from the driver. By way of the air-conditioning compressor switch-on signal $S_{KO}$, the information is transmitted to the electronic engine control unit 1 that the air-conditioning compressor is active and, as a result, the idling rotational speed, for example, must be raised. By logically monitoring these two signals, the electronic engine control unit 1 or the function block 4 recognizes a failure or a defect if the air-conditioning system readiness signal $S_{AC}$ is present ($S_{AC}$=0) but the air-conditioning compressor switch-on signal $S_{KO}$ indicates a switched-on air-conditioning compressor ($S_{KO}$=1). This signal combination $S_{AC}$=0 and $S_{K0}$=1 is emitted by the air-conditioning control unit 2 if a defect is present on parts of the air-conditioning unit, as particularly on the heat exchanger valve.

If such a defect signal is present, preferably for a preset time (dt) and the momentarily existing coolant temperature $T_{Kactual}$ is higher than a preset coolant temperature threshold $T_{Kpreset}$, the switching signal $S_T$ is actuated to electrically heat the thermostatic valve ($S_T$=1). The preset coolant temperature threshold $T_{Kpreset}$ may, for example, be defined as a function of various operating parameters in the case of a defect as a desired coolant temperature value $T_{Kdesired}$ instead of a desired value during the normal operation in a fixed or variable manner. Such a presetting of the desired value in the case of a defect may, as in the normal operation, take place by way of characteristic diagrams which are filed in the control unit. Also, for example, by way of the CAN bus, different defects can be reported and recognized. Thus, the coolant temperature threshold $T_{Kpreset}$ may be set in a different manner corresponding to the type of the defect or corresponding to the system which is reporting a defect.

According to this embodiment of the invention, a coolant temperature control system is provided which can be implemented in a flexible but also cost-saving manner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A coolant temperature control system for an internal-combustion engine of a motor vehicle which has a radiator through which a coolant flows, at least one other system through which the coolant flows, and a thermostatic valve which can be electrically heated to increase the coolant flow through the radiator, said control system comprising at least one control device which recognizes a defect of said at least one other system, wherein the thermostatic valve is electrically heated when the at least one control device recognizes said defect of said at least one other system.

2. A coolant temperature control system according to claim 1, wherein the thermostatic valve is controlled such that the actual coolant temperature is maintained below a preset coolant temperature threshold when the at least one control device recognizes said defect of said at least one other system.

3. A coolant temperature control system according to claim 1, wherein the at least one control device recognizes said defect by logically monitoring output signals of said at least one other system.

4. A coolant temperature control system according to claim 2, wherein the at least one control device recognizes said defect by logically monitoring output signals of said at least one other system.

5. A coolant temperature control system according to claim 1, wherein said at least one other system comprises at least one of a heating system and an air-conditioning system.

6. A coolant temperature control system for an internal-combustion engine of a motor vehicle which has a radiator through which a coolant flows, at least one other system through which the coolant flows, and a thermostatic valve which can be electrically heated to increase the coolant flow through the radiator, said control system comprising at least one control device which recognizes a defect of said at least one other system, wherein the at least one control device actuates the electrical heating of the thermostatic valve when the at least one control device recognizes said defect of said at least one other system.

7. A coolant temperature control system according to claim 6, wherein an actual coolant temperature signal is input into said at least one control device, and said at least one control device controls the thermostatic valve such that the actual coolant temperature is maintained below a preset coolant temperature threshold when the at least one control device recognizes said defect of said at least one other system.

8. A coolant temperature control system according to claim 6, wherein the at least one control device recognizes said defect by logically monitoring output signals of said at least one other system.

9. A coolant temperature control system according to claim 7, wherein the at least one control device recognizes said defect by logically monitoring output signals of said at least one other system.

10. A coolant temperature control system according to claim 6, wherein said at least one other system comprises at least one of a heating system and an air-conditioning system.

11. A method for controlling the coolant temperature of an internal-combustion engine of a motor vehicle which has a radiator through which a coolant flows, at least one other system through which the coolant flows, and a thermostatic valve which can be electrically heated to increase the coolant flow through the radiator, said method comprising the steps of:

monitoring the at least one other system with at least one control device to recognize a defect; and actuating the electrical heating said thermostatic valve when said defect is recognized.

* * * * *